US006745716B2

(12) United States Patent
Belyeu

(10) Patent No.: US 6,745,716 B2
(45) Date of Patent: Jun. 8, 2004

(54) MODULAR KAYAK

(76) Inventor: Dan Belyeu, 3316 Greens Mill Rd., Spring Hill, TN (US) 37174

( * ) Notice: Subject to any disclaimer, the term of this patent is extended or adjusted under 35 U.S.C. 154(b) by 0 days.

(21) Appl. No.: 10/462,134

(22) Filed: Jun. 16, 2003

(65) Prior Publication Data

US 2003/0233971 A1 Dec. 25, 2003

Related U.S. Application Data

(60) Provisional application No. 60/390,078, filed on Jun. 20, 2002.

(51) Int. Cl.[7] ..... B63B 35/71
(52) U.S. Cl. ..... 114/347
(58) Field of Search ..... 114/343, 347, 114/357, 363

(56) References Cited

U.S. PATENT DOCUMENTS

| | | | | |
|---|---|---|---|---|
| 4,727,821 | A * | 3/1988 | Masters | 114/347 |
| 4,799,446 | A | 1/1989 | Wilson | |
| 5,331,916 | A | 7/1994 | Martin | |
| 5,349,918 | A | 9/1994 | Elie | |
| 5,397,525 | A | 3/1995 | Niemier | |
| 5,582,126 | A | 12/1996 | Rypinski | |
| D385,528 | S | 10/1997 | Cronin | |
| D391,916 | S | 3/1998 | Masters | |
| 5,787,836 | A | 8/1998 | Blaisdell | |
| 5,964,177 | A | 10/1999 | Niemier | |

(List continued on next page.)

FOREIGN PATENT DOCUMENTS

| | | |
|---|---|---|
| EP | 0855338 A2 | 1/1998 |
| GB | 2172553 A | 9/1986 |
| HU | HU71673 | 1/1996 |

OTHER PUBLICATIONS

Cobra Kayak Corp. Multi Part Portable Kayak, www.kayaksforsale.com/website444_133.htm.
Lake George Kayak Co. "Clondike Convertible Kayak" www.lakegeorgekayak.com/feathercraft_kayaks_klondike.
Ocean Kayak 'Manta', www.paddlesportsofsantabarbara.com/ocean_kayak_3ihtm.
Ocean Kayak 'Down Trak ker', www.oceansports.ca/pages/ocean%20kayaksihtml.
Tieken Kayaks 'Take Apart Sea Kayak', www.marinens.com/tieken/tke_apart.htm.

*Primary Examiner*—S. Joseph Morano
*Assistant Examiner*—Lars A. Olson

(57) ABSTRACT

A multi-part kayak whereby the kayak body is hollow and void of a center where a traditional sit-on-top kayak cockpit would reside. The kayak body thus having a centralized hole therethrough. Surrounded by the hollow perimeter body the design is best analogous to a doughnut with a hole in its center. The kayak perimeter body is designed to accommodate multiple central hulls which can additionally accept multiple cockpit configurations via insertion into the central hull. Additionally such arrangement provides removable central hulls to be affixed in a manner whereby no mechanical fasteners or points of possible water intrusion exist below the waterline. Means are provided so as to prevent occupants weight from forcing the removable central hull downward through the kayak body and from wave action forcing the removable central hull upward through the kayak body. One kayak body can accommodate multiple configurations of removable central hulls thereby eliminating the need for various kayaks to perform various functions. Additionally, the cost of shipping multiple boats is reduced as sales outlets can order a limited number of kayak bodies and multiple central hull arrangements and satisfy the needs of multiple clients. Lastly the ability to replace a kayak body or central hull extends the life of the kayak by providing a means of replacement for damaged hull components rather than replacing an entire kayak.

18 Claims, 13 Drawing Sheets

U.S. PATENT DOCUMENTS 5,970,903 A * 10/1999 McDonough et al. ..... 114/347
6,112,692 A 9/2000 Lekhtman
6,112,693 A * 9/2000 Addison ..... 114/347
6,152,063 A 11/2000 Niemier
6,178,912 B1 1/2001 Niemier
6,325,014 B1 12/2001 Blanchard
6,394,020 B1 5/2002 Belyeu
6,443,089 B1 * 9/2002 Goucher et al. ..... 114/347

* cited by examiner

MODULAR KAYAK

This application claims the benefit of Provisional Patent Application Ser. No. 60/390,078 filed Jun. 20, 2002.

FEDERALLY SPONSORED RESEARCH

Not Applicable

SEQUENCE LISTING OR PROGRAM

Not Applicable

BACKGROUND

1. Field of Invention

This invention relates generally to human propelled water craft such as kayaks and canoes and, more particularly those of the sit-on-top variety.

2. Description of Prior Art

The prior art is replete with rotationally molded kayak designs and manufacturing processes. Additionally prior art abounds with modular and multi part boats and watercraft of varying styles. However, no specific prior art incorporates the methods, and designs contained herein in part or combination.

Conventional kayaks comprise a hollow shell in which the paddlers lower body and legs are received through an opening in the shell. These kayaks require a certain amount of skill to operate as the kayaker must learn to "self-rescue", or roll the kayak into an upright position if the kayak is tipped over.

An alternative type of kayak has been developed and has gained wide acceptance. This type of kayak is referred to in the paddle sports industry and herein as a sit-on-top kayak. As this name suggests, the user of a sit-on-top kayak sits on top of the kayak, not within it, or within a shallow recess in the top side of the kayak. The sit-on-top kayak is somewhat similar to a surfboard in overall shape. The process of manufacturing rotationally-molded polyethylene sit-on-top kayaks is generally discussed in U.S. Pat. Nos. 5,397,525 5,964,177 6,152,063 and 6,178,912 issued to Timothy A. Niemier.

Prior art also teaches the use of modular boat designs for convenience in assembly, shipping and transporting as is described by Blanchard in U.S. Pat. No. 6,325,014 and Blaisdell in U.S. Pat. No. 5,787,836. Another prior art is the ornamental design for a modular kayak by Michael Stefan Leoniak, Andrei Markevich, Marco Date, Art Center College of Design which shows a sit-on-top design unlike the present invention. Additionally, Tieken products manufactures a multi-part kayak for storage and transportation purposes whereby the boat disassembles in longitudinal parts/sections. Cobra Kayaks, Inc. Manufactures a three part sit-on-top kayak which divides into a bow, stern, and center section. The art is replete with designs that allow multiple configurations of the upper sections of kayaks and boats in general by placing a component such as a spray skirt or hard hatch over the top of the kayak, however, there exists no kayak design which actually allows for reconfiguration by changing the complete interior and center hull section for varying uses and/or paddler seating configurations. Belyeu describes the use of unitarily forming canoe and kayak hulls from transparent material in U.S. Pat. No. 6,394,020. Accordingly, the central hull component of the present invention could be made of transparent thermoplastic to afford underwater viewing.

Additionally, Martin (U.S. Pat. No. 5,331,916) and Masters (U.S. Pat. No. 4,727,821) teach the use of removable inserts for converting a canoe to a kayak and removable inserts referred to as a pod in which the paddler sits, respectively. Martin describes a kayak having a well in the upper deck into which the paddler sits as well as an insert having a bottom surface which is a mating fit within the well in the kayak also upon which the paddler sits. He further describes the removable insert as a flush upper deck upon which a paddler sits during use of the kayak as an outrigger canoe. Neither Martin nor Masters teach of a unitarily formed hollow kayak perimeter hull with a centrally located void interior open on the top and bottom, rather they teach the use of an insert with a bottom which rests upon the interior bottom of the kayak, thus each teaches of having two bottoms; one resting upon the other. Unlike the present invention, Martin teaches of the use of a well, not a void open on the top and bottom. Martin and Masters each teach of a dual bottom beneath the paddler when their devices are in place within the kayak. Neither teach of a single bottom in the cockpit when the insert is in place. The present invention teaches of a totally modular kayak central hull whereby the seating and storage area along with the entire central hull configuration may be removed and or replaced with one of a different configuration. The present invention also teaches the use of two hulls each of which can be removed from the other and each of which contact the water thus providing a surface upon which the entire kayak is buoyantly supported. Additionally, each component of the present invention is individually buoyant when in place, thus the interior centrally located hull remains buoyant even when the perimeter hull has been breached, and vice versa.

The need thus exists for a kayak design that provides reconfiguration for varying paddling needs and situations.

From the foregoing, it should be clear that one primary object of the present invention is to provide an improved kayak design.

OBJECTS AND ADVANTAGES

It is a particular object of the invention to reduce the cost and enhance the enjoyment of kayaking by providing a kayak whereby a plurality of configuration may be obtained by replacement of the cockpit and central hull sections. In essence this invention is a modular kayak whereby the primary hull of the kayak is unitarily formed by traditional rotational molding processes or fiber-composite lay-up methods and the removable cockpit central hull section of the kayak is independently produced via fiber-composite lay-up, blow-molding, thermoforming, vacuum forming, or rotationally molding thermoplastics into a pre-defined size with peripheral edges shaped to interlock within the primary hull. Each removable cockpit central hull has seating and storage areas and hull shapes designed for different functional uses.

Further objects and advantages of the present invention are:

(a) to provide a kayak of sufficient lateral and longitudinal strength to require no internal supporting structure;

(b) to provide a kayak with a replaceable removable cockpit central hull of sufficient flexibility and strength and attachment means to withstand severe impacts without becoming dislodged from the hull;

(c) to provide a kayak within which different removable cockpit central hull configurations may be inserted to fit the particular needs of a paddler.

(d) to provide a kayak with a removable cockpit central hull which may be replaced in the event of damage without rendering the entire kayak unusable.

(e) to provide a low-cost modular designed kayak whereby the benefits of multiple kayaks may be realized without the expense of the purchase of multiple kayaks.

Further objects and advantages are to provide a transparent removable cockpit central hull for a kayak that is stable to paddle, inexpensive to manufacture, light in weight, and allows for variations in removable cockpit central hull designs without alteration of the mold from which the hull of the kayak was formed. Still further objects and advantages will become apparent from a consideration of the ensuing description and drawings.

SUMMARY

In accordance with the present invention a modular cockpit designed kayak comprises a seamless, unitarily formed, primary hull whereby the interior portion of the kayak hull where traditional cockpits reside is absent. Placed within the void of the space traditionally reserved for the cockpit can be varying styles of inserts which serve as the removable cockpit central hull. The removable cockpit central hulls are constructed in such a manner as to allow interchangeableness without compromising the integrity of the boats strength, waterproofness or portability. Further, the design of the hull structure is such that the insertion of the removable cockpit central hull is not necessary for the kayak to remain buoyant and functional. Additionally, the removable cockpit central hull will not be forced through the hull by paddler weight due to its interlocking upper lip, draft angle of the inner perimeter of the primary hull and perimeter fasteners inserted through the removable cockpit central hull into receptacle formed within and encircling the top ledge of the primary hull. Additionally, bosses and mating fit receptacles in the primary hull and removable cockpit central hull interlock for added strength.

This invention is a multi-part kayak with a unitarily formed primary hull and deck having no interior or cockpit, but rather a void center where a traditional sit-on-top kayak cockpit would reside. A separate removable cockpit central hull which can be inserted into the primary hull void thereby affording the user of the kayak the ability to alter the design and use of the kayak by changing the removable cockpit central hull portion. Specifically, the process and design described herein allows for multiple uses from a kayak hull which can be fitted with varying removable cockpit central hull designs and styles to fit varying uses.

The term sit-on-top kayak as used herein refers to the popular design of kayak whereby the paddler sits on the kayak rather than inside it. We are using this term because this invention more closely relates to a sit-on-top kayak than any other kayak known. However, the term sit-on-top used herein is for relational purposes and not to be construed in a limiting sense as will become clear as descriptions of varying modular removable cockpit central hulls are disclosed.

One such use affords the paddler an underwater view while paddling simply by inserting a removable cockpit central hull molded from transparent material into the primary kayak hull. Another use it to provide a half removable cockpit central hull whereby the paddler can enter and exit the water through the void remaining in the other half of the cockpit receptacle area, thus facilitating self-rescue and preventing capsizing the craft which often occurs during a side re-entry. Yet another use may be a removable cockpit central hull design that allows for two persons to paddle comfortably in the same craft, which could optionally be constructed of transparent material to provide underwater viewing. The kayak could be configured with a canoe type seat and sliding foot braces thus leaving the entire central area open and void of a cockpit. The combinations of the types of removable cockpit central hulls which could be mounted into the kayak are limitless, however, the configuration of the kayak hull structure must be such that the structural integrity of the craft is not compromised, and is configured in a manner that provides seamless integrity.

Sit-on-top kayaks are generally inexpensive and non-confining, however they are generally designed for specific usages. There are sit-on-top kayaks specifically designed for scuba divers. There are commercially available sit-on-top kayaks designed specifically for fishing. There are sit-on-top kayaks designed for solo paddlers. There are sit-on-top kayak designs for tandem, triple and more paddlers. There are sit-on-top kayak designs for wave skiing, surfing, and towing. But the traits of each are limiting in the use of the craft. This most popular of kayak designs (the sit-on-top kayak) is generally non-conforming to different uses.

Specifically we are seeking patent protection for a manufacturing/assembly process which incorporates the flexibility to alter the configuration and function of the kayak by simply inserting the removable cockpit central hull design required for the desired usage. This kayak will solve the following problems: 1) provide the inexpensive, rugged dependability of rotationally molded thermoplastic within a kayak design that provides the means for insertion of a plurality of removable cockpit central hulls 2) reduce the need to own multiple sit-on-top kayaks for multiple uses 3) allow the replacement of damaged kayak components without replacing the entire kayak 4) reduce the amount of storage space required for multiple kayaks for multiple uses 5) allow for underwater viewing by providing a removable cockpit central hull made of transparent material; resulting in a transparent bottom kayak with a low cost of manufacture, lightness of weight, optical clarity, repairableness, and seamless below the waterline 6) provide the ability to insert a traditional style kayak cockpit for those desiring to paddle with a spray skirt (such as is required in cold water and open water usage) without giving up the benefits of sit-on-top kayak usage but while realizing the benefits of sit-inside kayak dryness and comfort 7) provide a method whereby dealers and distributors may stock one model of kayak primary hull and outfit the kayak with the removable cockpit central hull of the consumers choice, thus eliminating the need for excess bulky inventory and freight since the removable cockpit central hulls will nest within one another for ease of shipping.

DRAWINGS

The above and other embodiments of the present invention may be more fully understood from the following detailed description, taken together with the accompanying drawings, wherein similar reference characters refer to similar elements throughout, and in which.

DETAILED DESCRIPTION OF PREFERRED EMBODIMENTS

Figure 1:
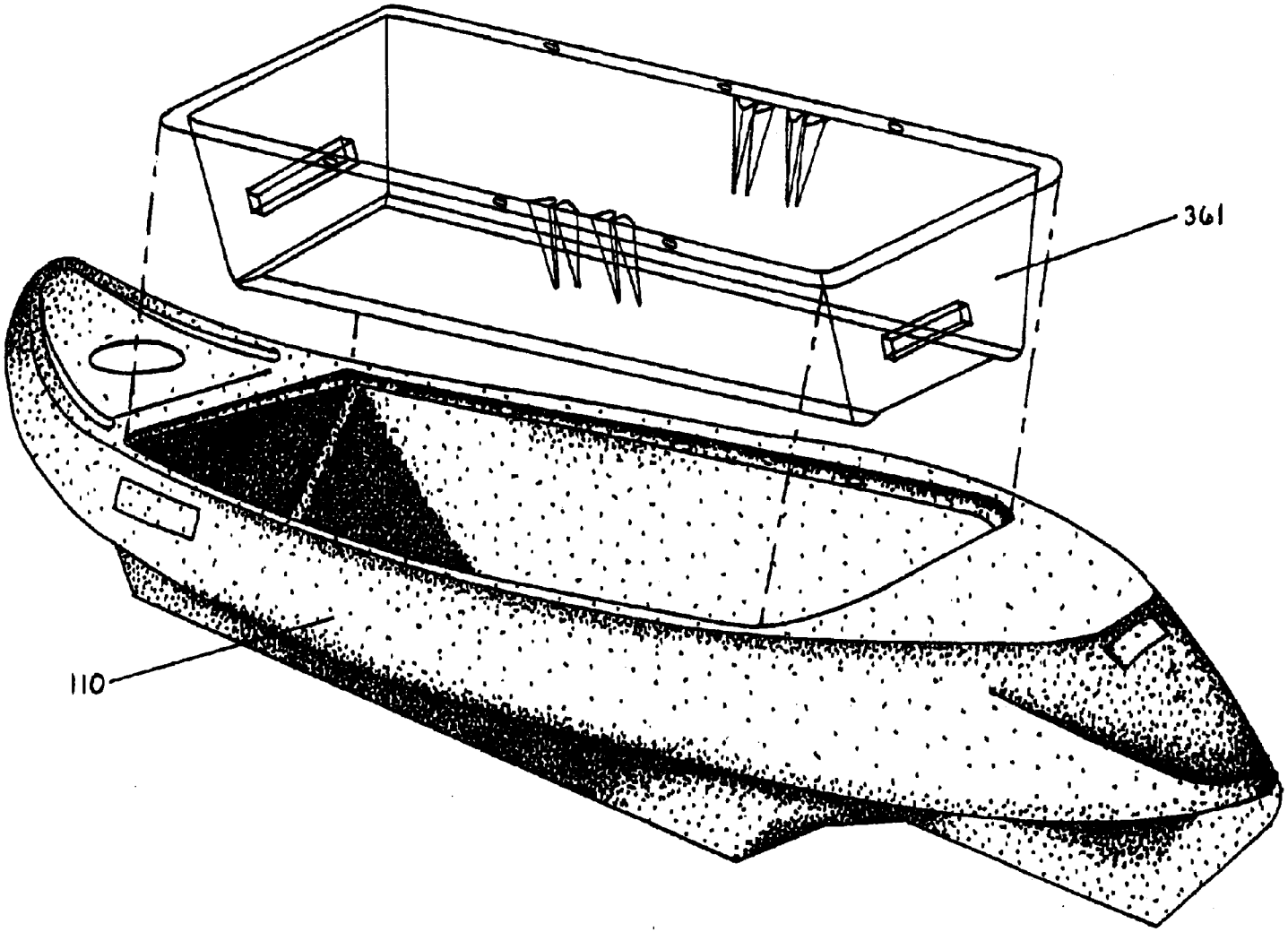
FIG. 1 is an isometric view of the modular kayak body perimeter hull and the removable cockpit central hull aligned for assembly, taken from an upper side end location.
Figure 2:
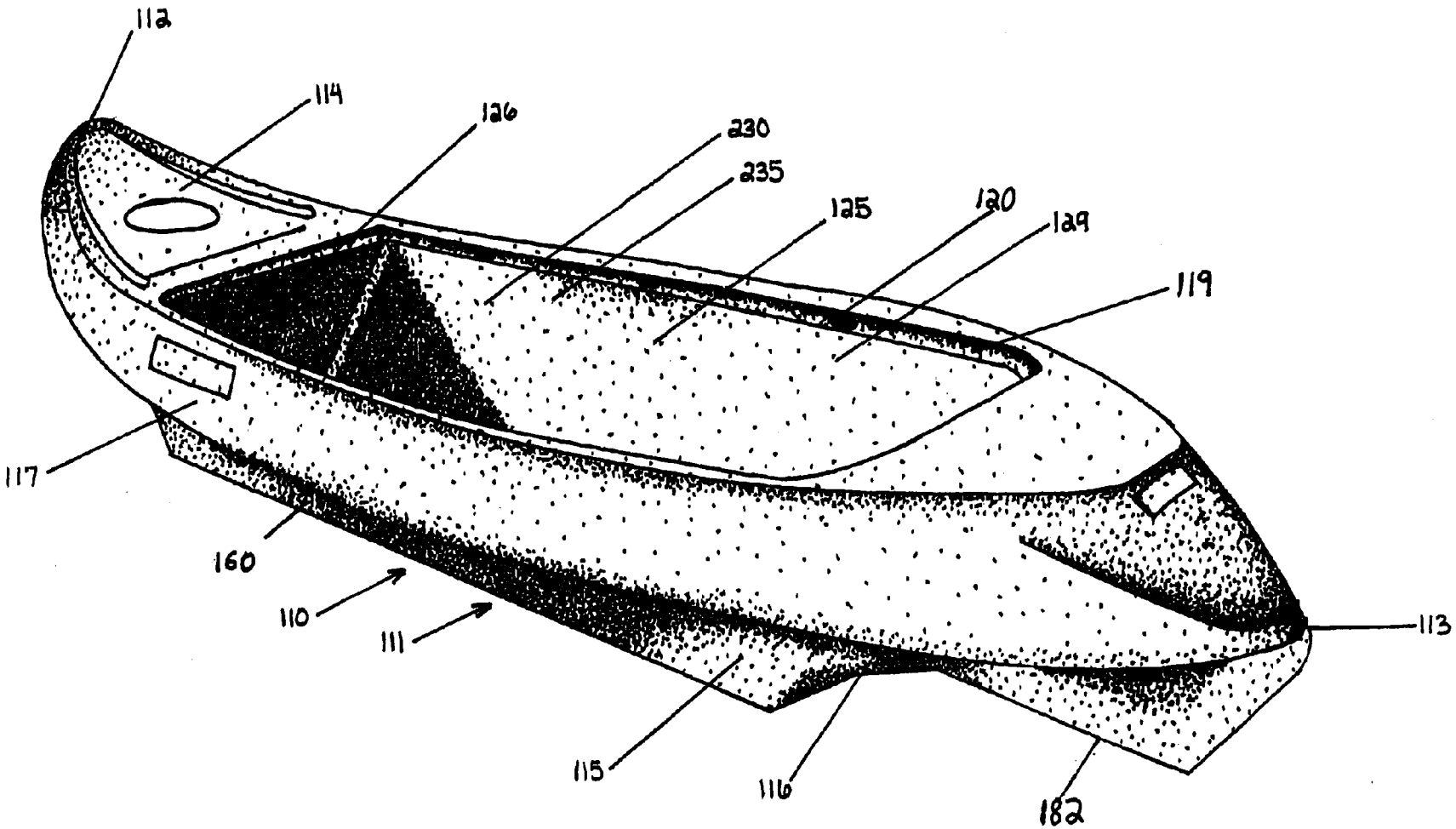
FIG. 2 is an isometric view of the modular kayak body perimeter hull, taken from an upper side rear end location.
Figure 3:
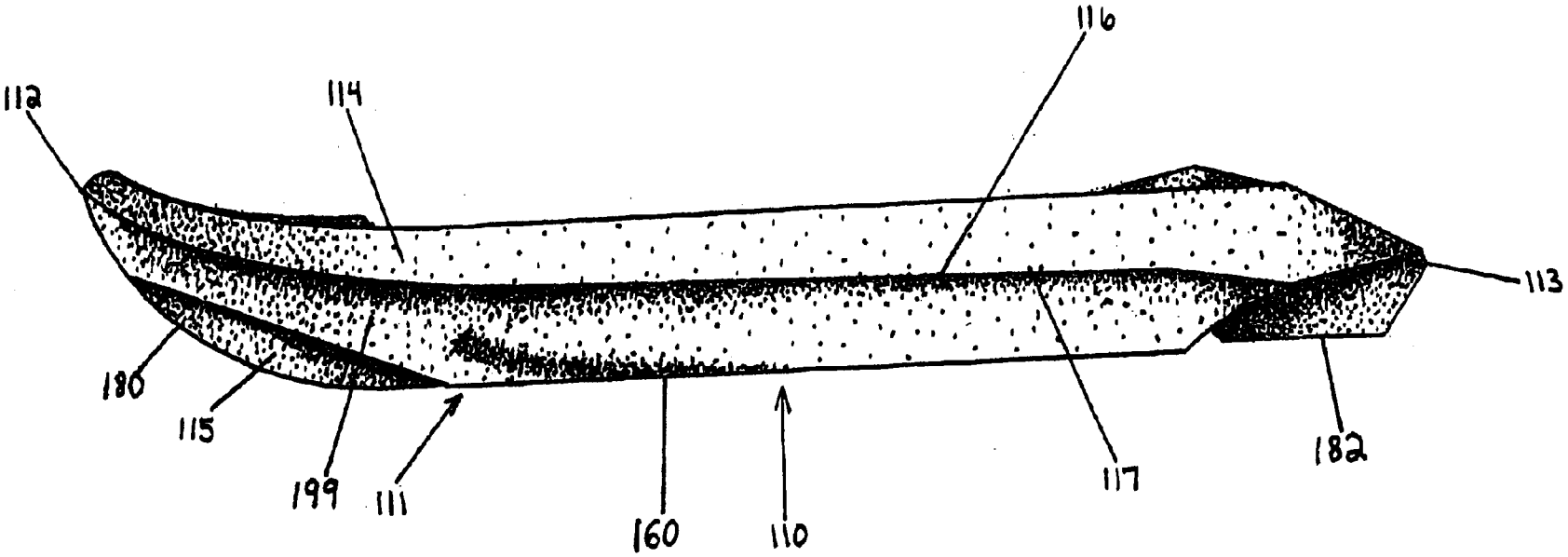
FIG. 3 is a side elevation view of the modular kayak body perimeter hull.

Referring initially to FIG. 1 of the drawings, depicted at 110 is a modular kayak body perimeter hull and the removable cockpit central hull 361, constructed in accordance with, and embodying, the principles of the present invention, Referring now to FIGS. 2–7 of the drawings, depicted are various views and elements of the modular kayak body perimeter hull 110 constructed in accordance with, and embodying, the principles of the present invention.

The modular kayak body perimeter hull 110 has an outer surface 111 defining a bow end 112 and a stern end 113 and a port side 117 and a starboard side 118 and a top side 114 and a bottom side 115 separated by a parting line 116 extending around the perimeter of the modular kayak body perimeter hull 110. The modular kayak body perimeter hull 110 further comprises an inner surface 125 defining a first end 126 and a second end 127 as well as a first side 128 and a second side 129.

The cockpit area 230 is a void within the modular kayak body perimeter hull 110 surrounded by the modular kayak body perimeter hull inner surface 125. The cockpit area 230 comprises a top opening 235 and a bottom opening 238. The top opening 235 is greater in length and width than the bottom opening 238. The top opening 235 and the bottom opening 238 are separated vertically by the inner surface 125, specifically the first end 126, the second end 127, the first side 128 and the second side 129.

Formed within the modular kayak body perimeter hull inner surface 125 are a body receptacle 142 and a body boss 143. The body receptacle 142 is formed within the first end 126 and the body boss is formed within the second end 127.

Formed within modular kayak body perimeter hull outer surface top side 114 is a recess 119 surrounding the perimeter of the cockpit area top opening 235. The recess 119 surrounding the perimeter of the cockpit area top opening 235 includes recessed receptacles 120 formed within the recess 119. The body receptacle 142, body boss 143, recess 119 and recessed receptacles 120 are present for releasibly attaching cockpits and accessories to and within the modular kayak body perimeter hull 110.

The modular kayak body perimeter hull outer surface bottom side 115 further comprises a fore keel 180 and an aft keel 182 and a fore planing surface 185 and an aft planing surface 186 to enhance speed, stability and performance. The fore keel 180 extends in a downward arc from the bow end 112 to a point of intersection with the fore planing surface 185. The aft keel 182 extends in a horizontal plane from the outer surface stem end 113 to a point of intersection with the aft planing surface 186.

The modular kayak body perimeter hull outer surface bottom side 115 further comprises forward primary wave flares 196 and forward secondary wave flares 199 which act to part and separate oncoming waves in such a manner as to throw wave spray out and away from the paddler thus improving visibility and safety. The forward primary wave flares 196 and the forward secondary wave flares 199 additionally serve to prevent the bow of the kayak from submerging while wave surfing or paddling into an oncoming surf.

The modular kayak body perimeter hull outer surface bottom side 115 further comprises a flat longitudinal planing surface 160 which aids in the stability of the kayak as well as allows for easy turning.

The modular kayak body perimeter hull outer surface bottom side 115 further comprises rear flow tunnels 190 which provide a tri-hull stabilizing effect as well as a wave parting function for rear approaching waves as encountered during wave surfing.

Referring now to FIGS. 8–13 shown herein is the removable cockpit central hull 361 and various views showing individual elements thereof. The removable cockpit central hull 361 defines an outer first end 363 and an outer second end 364 and an outer first side 365 and an outer second side 366 and an underside top perimeter lip 367 and a outer bottom exterior hull 368 and an inner surface 369. The inner surface 369 comprises an inner surface first end 371 and an inner surface second end 372 and an inner surface first side 373 and an inner surface second side 374 and a perimeter lip top side 375 and a bottom interior hull 376 and a cockpit boss 378 formed within the outer first end 363 and a cockpit receptacle 379 formed within the outer second end 364.

When viewed from the inner surface 369, the cockpit boss 378 is a recess within the inner surface first end 371 and the cockpit receptacle 379 is a boss within inner surface second end 372.

The removable cockpit central hull 361 further comprises bilge keels 398 traversing longitudinally on the outboard lower edge of the removable cockpit central hull outer sides 365 and 366 to a point just aft of the intersection of the outer bottom exterior hull 368 and the outer first end 363. The bilge keels 398 serve as tracking mechanism to aid in the straight steerage of the kayak as well as to provide protection from abrasion to the outer bottom exterior hull 368.

The removable cockpit central hull 361 further comprises accessory receptacles 395 and accessory bosses 393 formed into the inner surface first side 373 and inner surface second side 374. The accessory receptacles 395 and accessory bosses 393 allow for interlocking accessories such as foot braces and stowage boxes within the confines of the removable cockpit central hull 361.

Figure 4:
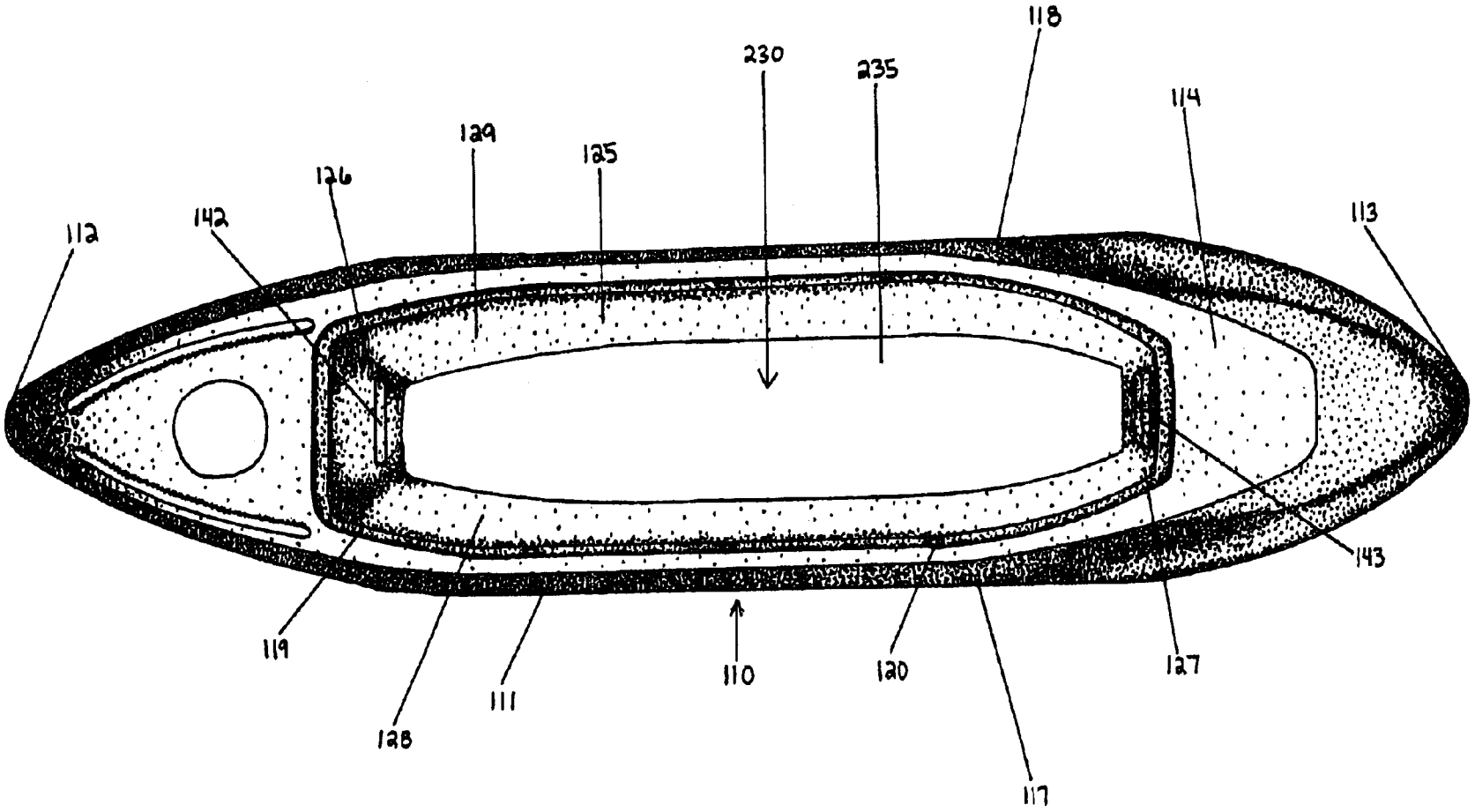
FIG. 4 is a top elevation view of the modular kayak body perimeter hull.
Figure 5:
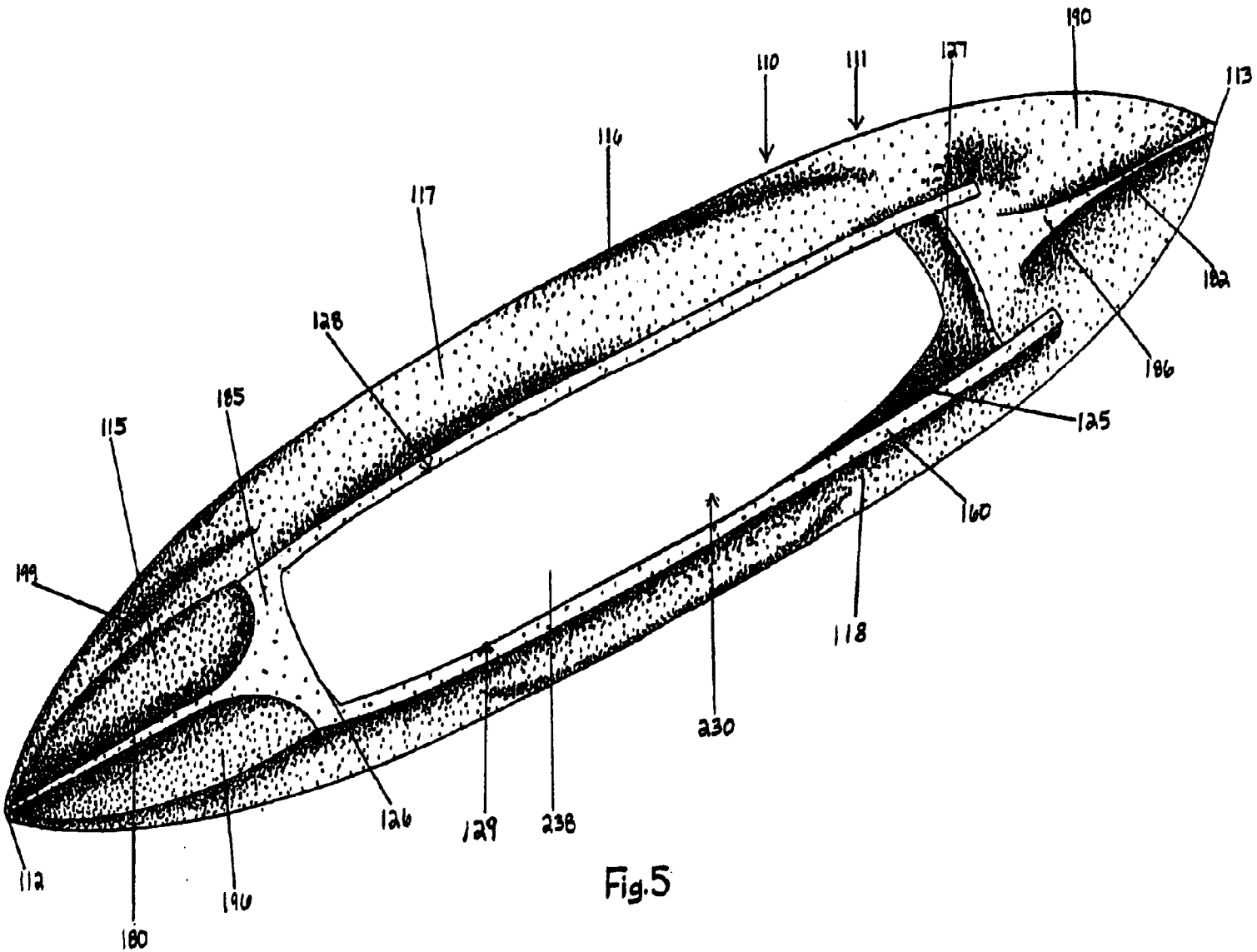
FIG. 5 is an isometric view of the modular kayak body perimeter hull, taken from an underside position and to one side thereof.
Figure 6:
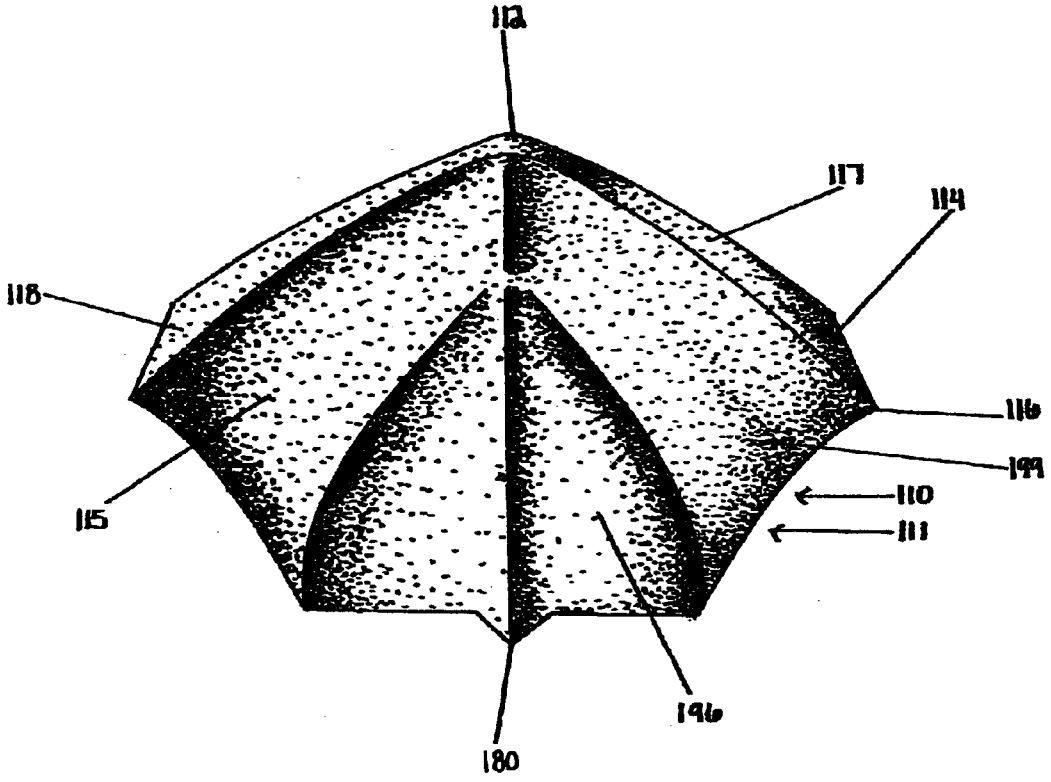
FIG. 6 is a front elevation view of the modular kayak body perimeter hull.
Figure 7:
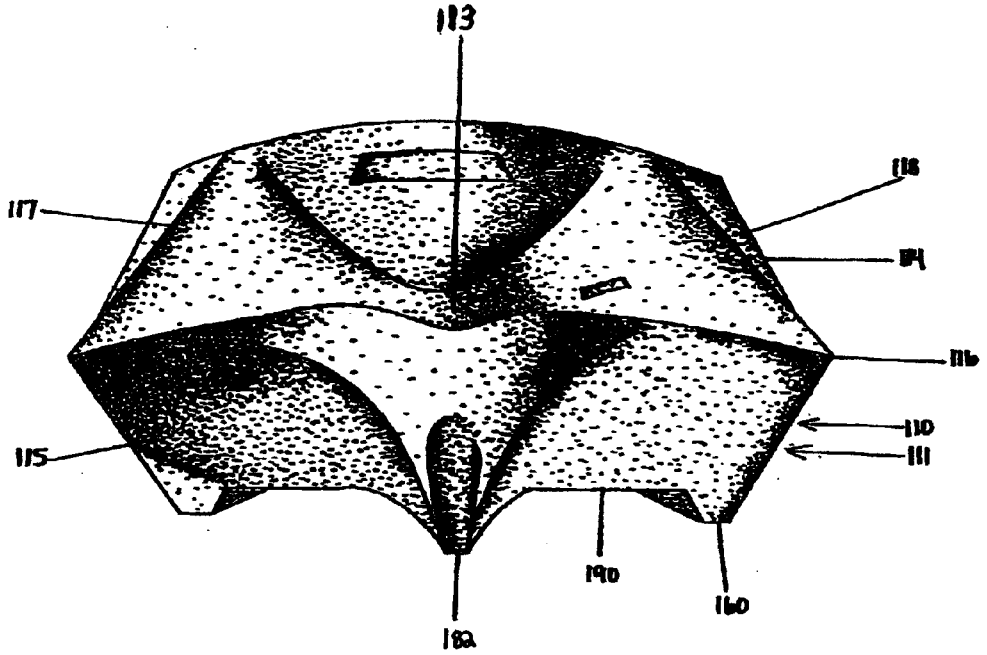
FIG. 7 is a rear elevation view of the modular kayak body perimeter hull.
Figure 8:
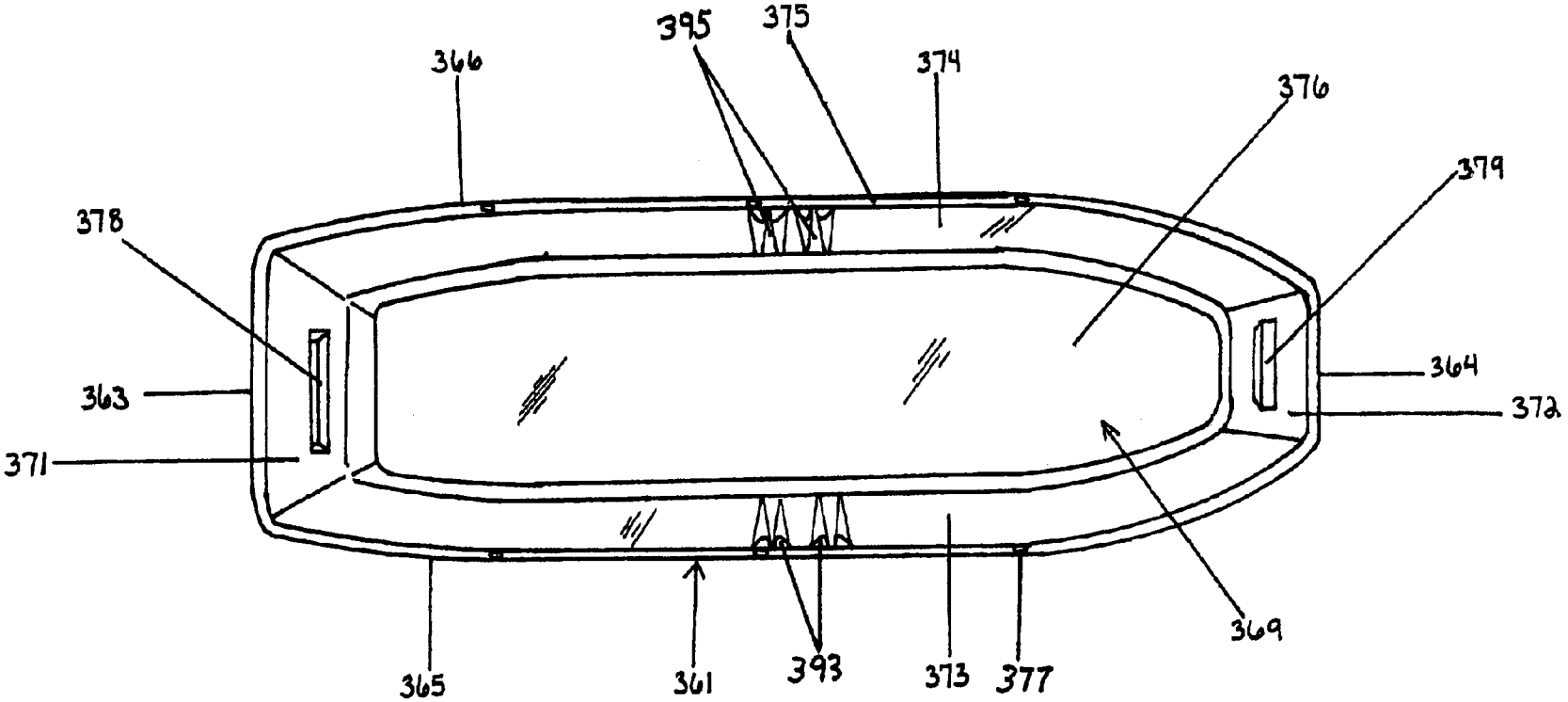
FIG. 8 is a top elevation view of the removable cockpit central hull.
Figure 9:
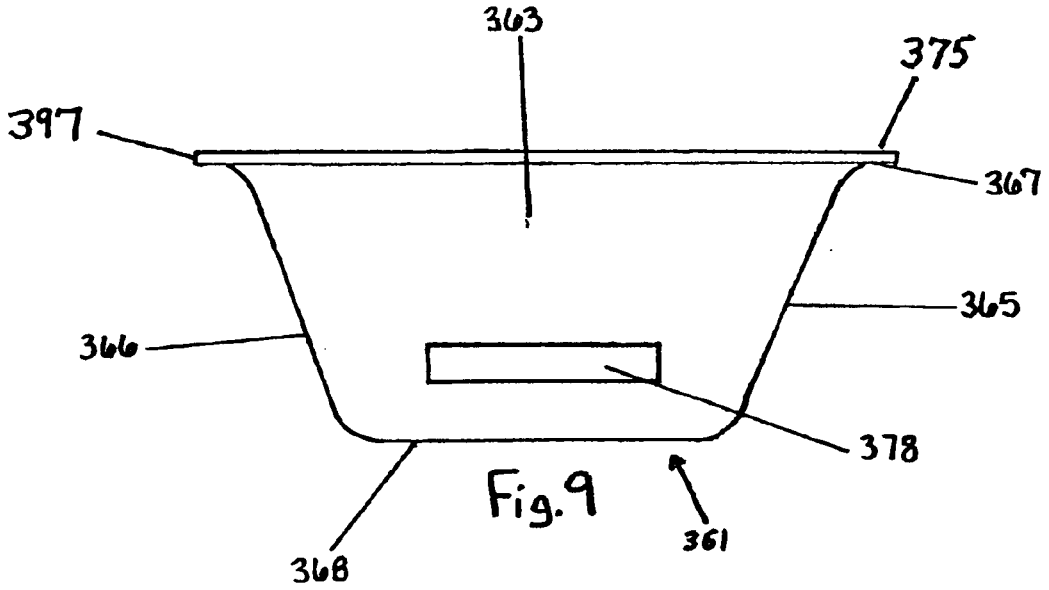
FIG. 9 is a front elevation view of the removable cockpit central hull.
Figure 10:
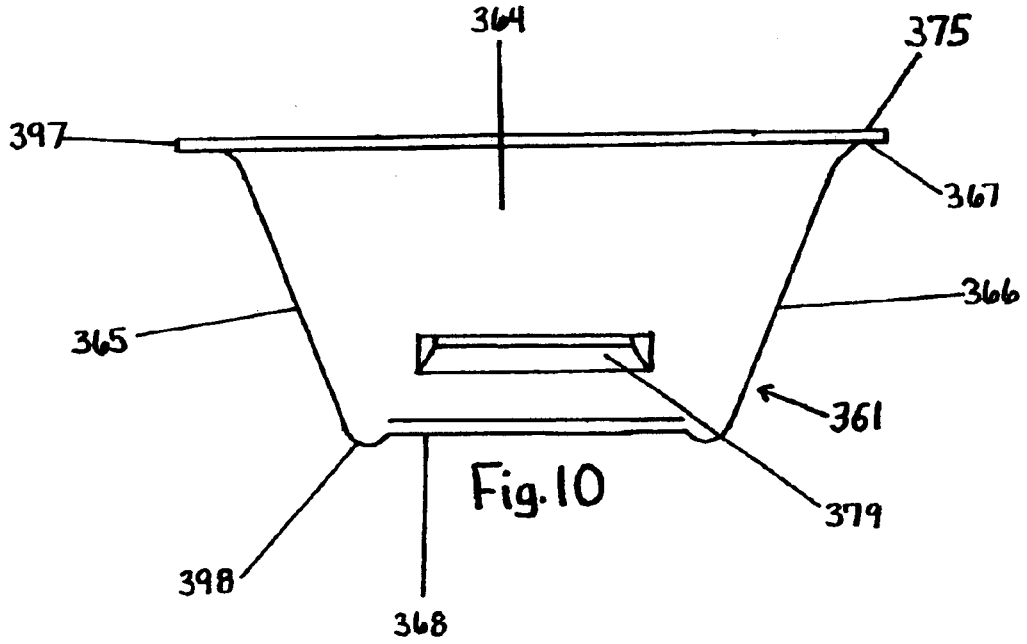
FIG. 10 is a rear elevation view of the removable cockpit central hull.
Figure 11:
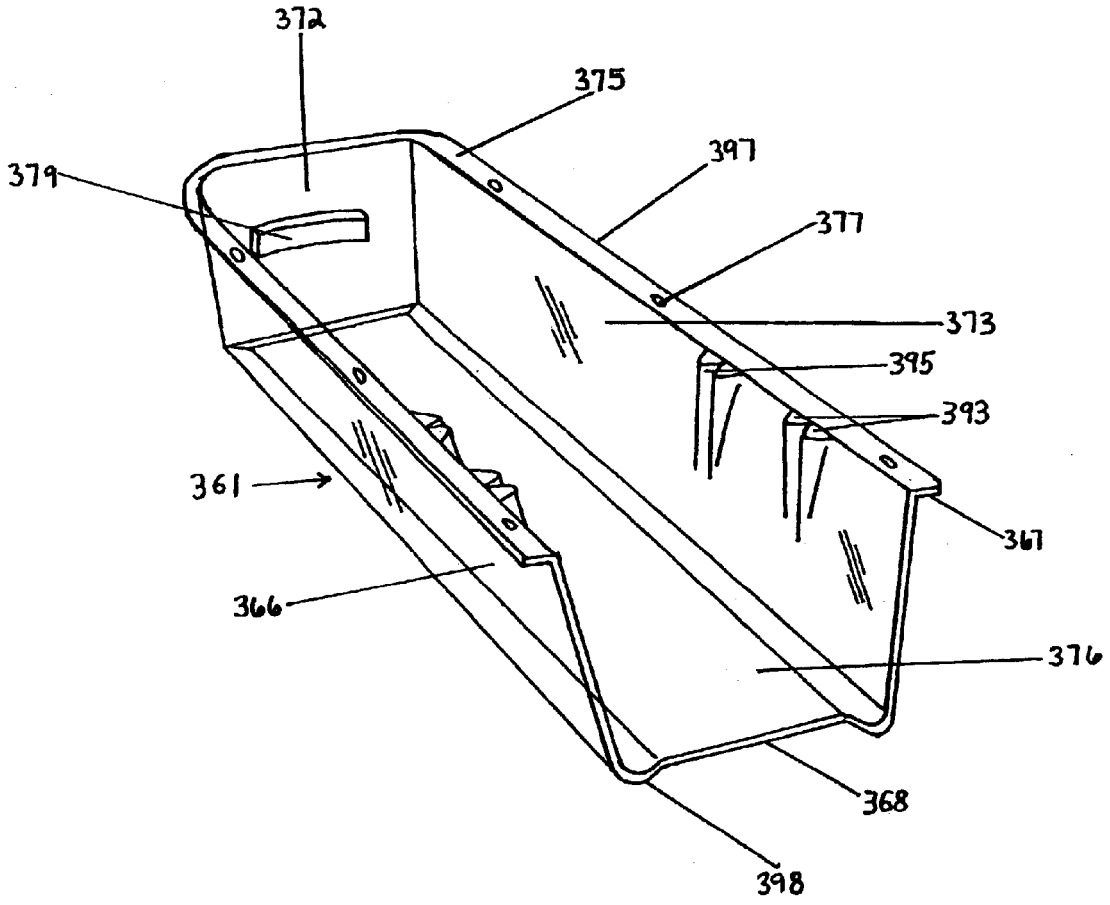
FIG. 11 is an isometric view of the removable cockpit central hull, taken from a front side position and one side thereof.
Figure 12:
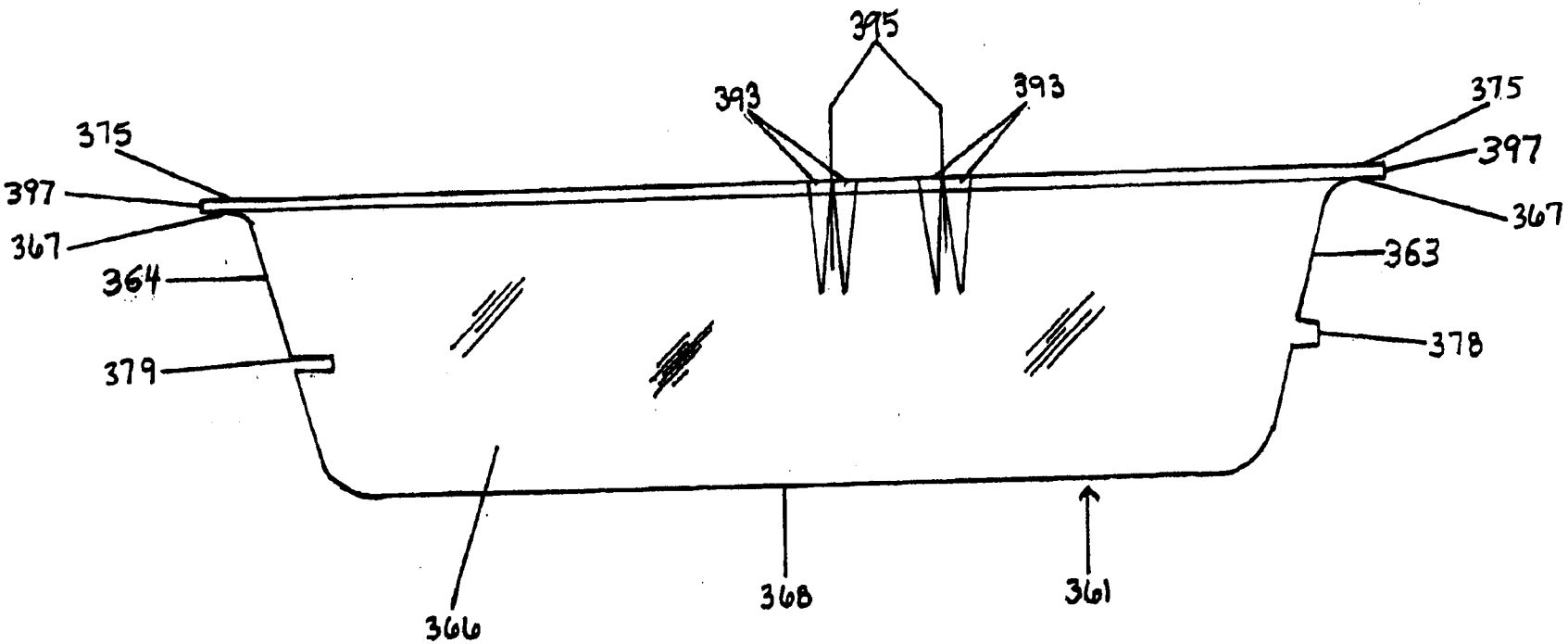
FIG. 12 is a side elevation view of the removable cockpit central hull.

The underside top perimeter lip 367 and the perimeter lip top side 375 comprise the cockpit flange 397. Within the cockpit flange 397 are slots 377 which align with the recessed receptacles 120 as shown in FIG. 4 for releasibly fastening the removable cockpit central hull 361 to the modular kayak body perimeter hull 110 via the use of fasteners. The cockpit flange 397 is a mating fit with the modular kayak body perimeter hull recess 119 as depicted in FIG. 4.

Figure 13:
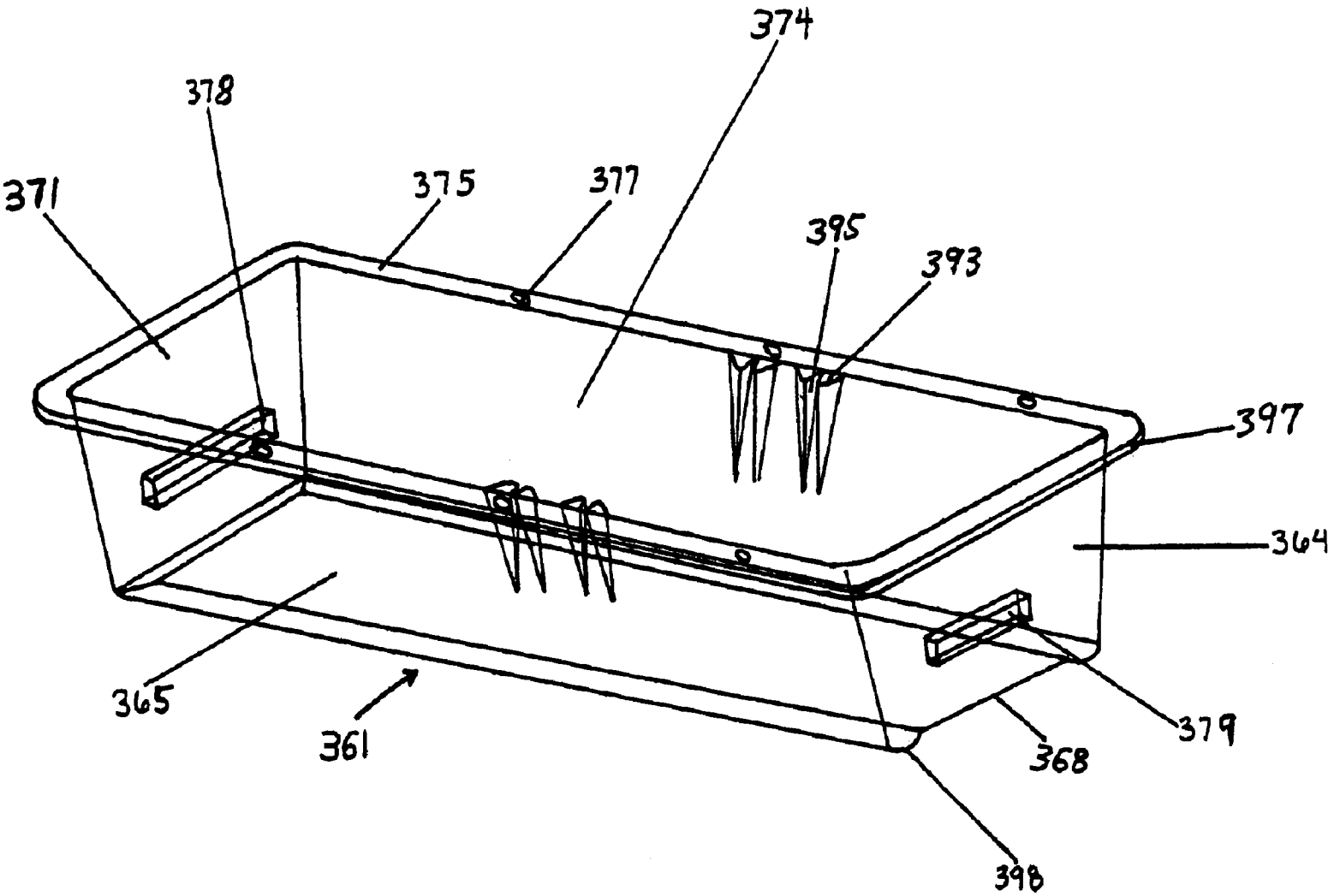
FIG. 13 is an isometric view of the removable cockpit central hull shown in transparent material, taken from a top rear position and to one side thereof.

Referring now to FIGS. 4 and 13, the slots 377, cockpit boss 378, and cockpit receptacle 379 are mating fits to recessed receptacles 120, body receptacle 142 and body boss 143 respectively and are present for releasibly attaching the removable cockpit central hull 361 to the modular kayak body perimeter hull 110.

Figure 14:
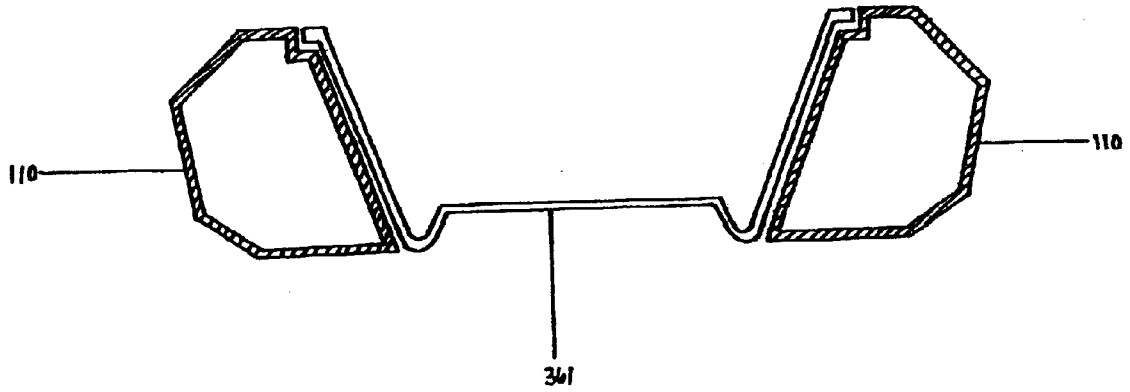
FIG. 14 is a front elevation cross sectional view of the modular kayak body perimeter hull with the removable cockpit central hull in place.

FIG. 14 is a front elevation cross sectional view of my modular kayak showing the modular kayak body perimeter hull 110 with the removable cockpit central hull 361 inserted within.

Figure 15:
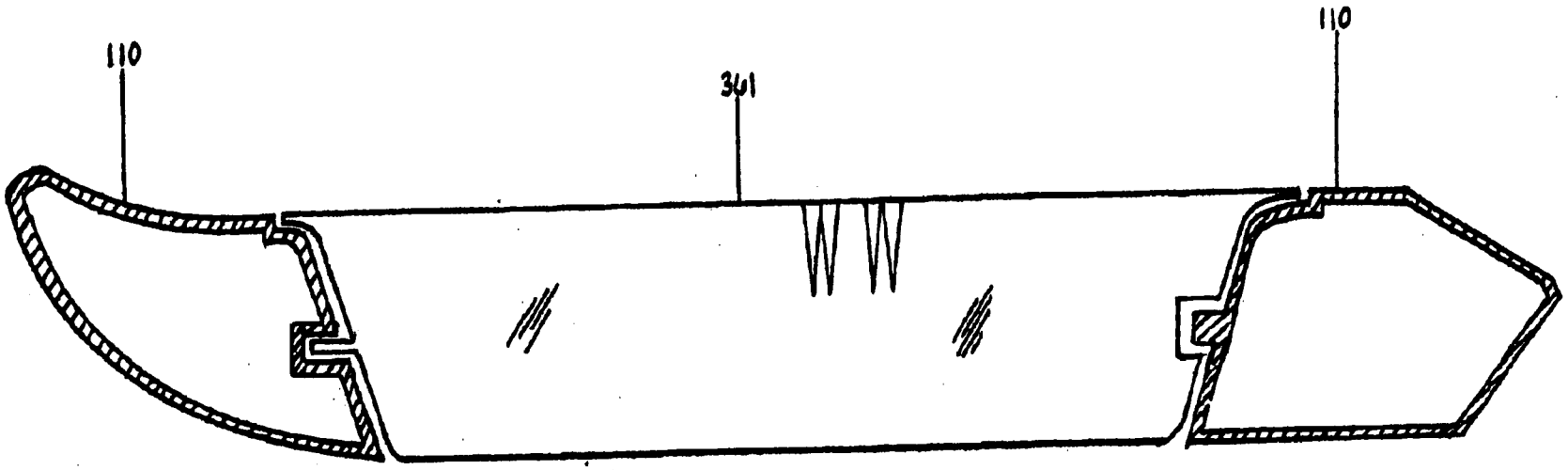
FIG. 15 is a side elevation cross sectional view of the modular kayak body perimeter hull with the removable cockpit central hull in place.

FIG. 15 is a side elevation cross sectional view of my modular kayak showing the modular kayak body perimeter hull 110 with the removable cockpit central hull 361 inserted within.

Since certain changes may be made in the above apparatus without departing from the scope of the invention herein involved, it is intended that all matter, including dimension and angles, contained in the above description, as shown in the accompanying drawings, shall be interpreted in an illustrative, and not a limiting sense. Accordingly, the present invention may be embodied in other forms without departing from the scope hereof. All changes that come within the meaning and scope of the claims are intended to be embraced therein.

What is claimed is:

1. A modular kayak, comprising:

a modular kayak body perimeter hull defining a surrounding hull and a central hull void, the surrounding hull having a bow end and a stem end longitudinally spaced from the bow end and a port side and a starboard side laterally spaced from the port side and a top side and a bottom side vertically spaced from the top side and an interior bow wall longitudinally spaced from said bow end and an interior stern wall longitudinally spaced from said stern end and longitudinally spaced from said bow wall, and a port interior wall laterally spaced from said port side and a starboard interior wall laterally spaced from said starboard side and laterally spaced from said port interior wall, the central hull void having no top and no bottom and surrounded by said interior bow wall, said interior stern wall, said port interior wall and said starboard interior wall, a removable central hull of a size and shape to fit within said central hull void;

attachment means for releasably attaching said removable central hull to said modular kayak body perimeter hull, whereby an exchange of said removable central hull or said modular kayak body perimeter hull may be facilitated independent of the other for varying usage and for replacement of damaged components.

2. The modular kayak of claim 1 wherein said modular kayak body perimeter hull is integrally formed as a single unitary member.

3. The modular kayak of claim 1 wherein said surrounding hull is hollow.

4. The modular kayak of claim 1 wherein said central hull void comprises an embrasure open on the top and open on the bottom and vertically surrounded by said interior bow wall, said interior stern wall, said port interior wall, and said starboard interior wall.

5. The modular kayak of claim 1 wherein said top side includes a recess surrounding the top perimeter of said central hull void and said removable central hull includes an upper perimeter ledge of a shape and size to provide a mating fit with said recess.

6. The modular kayak of claim 1 wherein said bottom side includes wave flares on said bow end.

7. The modular kayak of claim 1 wherein attachment means include receptacles formed within said surrounding hull.

8. The modular kayak of claim 7 wherein said receptacles include recesses.

9. The modular kayak of claim 1 wherein attachment means include bosses formed within said perimeter hull inner surface.

10. The modular kayak of claim 1 wherein attachment means include receptacles formed within said removable central hull.

11. The modular kayak of claim 10 wherein said receptacles include apertures.

12. The modular kayak of claim 1 wherein attachment means include bosses formed within said removable central hull.

13. The modular kayak of claim 1 wherein said removable central hull is of a transparent material.

14. The modular kayak of claim 2 wherein said removable central hull further comprises bilge keels.

15. The modular kayak of claim 1 wherein said removable central hull includes means for releasably attaching a central hull cover.

16. The modular kayak of claim 1 wherein said removable central hull is unitarily formed.

17. A modular kayak, comprising:

an integrally formed hollow modular kayak body perimeter hull defining a surrounding hull and a central hull void, the surrounding hull having a bow end and a stern end longitudinally spaced from the bow end and a port side and a starboard side laterally spaced from the port side and a top side and a bottom side vertically spaced from the top side and an interior bow wall longitudinally spaced from said bow end and an interior stem wall longitudinally spaced from said stern end and longitudinally spaced from said interior bow wall, and a port interior wall laterally spaced from said port side and a starboard interior wall laterally spaced from said starboard side and laterally spaced from said port interior wall, the central hull void being an embrasure and having no top and no bottom and vertically surrounded by said interior bow wall, said interior stern wall, said port interior wall and said starboard interior wall;

a unitarily formed removable central hull of a transparent material of a size and shape to fit within said central hull void and containing bilge keels;

attachment means for releasably attaching said unitarily formed removable central hull to said integrally formed hollow modular kayak body perimeter hull, whereby an exchange of said unitarily formed removable central hull or said integrally formed hollow modular kayak body perimeter hull may be facilitated independent of the other for varying usage and for replacement of damaged components;

wave flares on said bow end.

18. A modular kayak, comprising:

a hollow modular kayak body perimeter hull integrally formed as an enclosed tubular single unitary member defining a perimeter hull outer surface and a perimeter hull inner surface, the perimeter hull outer surface having an outer first end and an outer second end longitudinally spaced from the outer first end and an outer first side and an outer second side laterally spaced from the outer first side and an outer top side and an outer bottom side vertically spaced from the outer top side, the perimeter huh inner surface having an inner first end and an inner second end longitudinally spaced from the inner first end and an inner first side and an inner second side laterally spaced from the inner first side;

a central hull area comprising an embrasuric void having no top or no bottom and vertically surrounded by said perimeter hull inner surface, whereby an opening extending therethrough is created;

a unitarily formed removable central hull of a size and shape to fit within said central hull area;

attachment means for releasably attaching said unitarily formed removable central hull within said central hull area whereby the weight of occupants is prevented from forcing said unitarily formed removable central hull downward through said central hull area and wave action is prevented from forcing said unitarily formed removable central hull upward through said central hull area and allowing for replacement of said unitarily formed removable central hull or said hollow modular kayak body perimeter hull for varying usage and for replacement of damaged components.

* * * * *

UNITED STATES PATENT AND TRADEMARK OFFICE

CERTIFICATE OF CORRECTION

PATENT NO. : 6,745,716 B2
APPLICATION NO. : 10/462134
DATED : June 8, 2004
INVENTOR(S) : Dan Belyeu It is certified that error appears in the above-identified patent and that said Letters Patent is hereby corrected as shown below:

In The Claims

Col. 7, Claim 1, Line 34:
DELETE after and a "stem"
ADD after and a --stern--

Col. 9, Claim 18, Line 6:
DELETE after perimeter "huh"
ADD after perimeter --hull--

Signed and Sealed this
Twelfth Day of May, 2015

Michelle K. Lee

Michelle K. Lee
*Director of the United States Patent and Trademark Office*